US011538447B2

(12) United States Patent
Wanne

(10) Patent No.: US 11,538,447 B2
(45) Date of Patent: Dec. 27, 2022

(54) INSTRUMENT MOUTHPIECE WITH AIR FLOW DISRUPTION APPARATUS

(71) Applicant: Wanne Inc., Bellingham, WA (US)

(72) Inventor: Theo Wanne, Bellingham, WA (US)

(73) Assignee: Wanne Inc., Bellingham, WA (US)

( * ) Notice: Subject to any disclaimer, the term of this patent is extended or adjusted under 35 U.S.C. 154(b) by 0 days.

(21) Appl. No.: 17/094,530

(22) Filed: Nov. 10, 2020

(65) Prior Publication Data

US 2022/0148543 A1 May 12, 2022

(51) Int. Cl.
*G10D 9/035* (2020.01)
*G10D 7/06* (2020.01)

(52) U.S. Cl.
CPC ..... *G10D 9/035* (2020.02); *G10D 7/06* (2013.01)

(58) Field of Classification Search
CPC ..... G10D 9/035; G10D 7/06; G10D 3/00
See application file for complete search history.

(56) References Cited

U.S. PATENT DOCUMENTS 2,180,130 A * 11/1939 Swanson ..... G10D 7/04 84/384
2005/0087057 A1 4/2005 Taillard
2008/0083316 A1 4/2008 Wanne
2010/0011937 A1* 1/2010 Hamanaga ..... G10D 9/03 84/398

FOREIGN PATENT DOCUMENTS

JP 2005331613 A * 12/2005 ..... G10D 9/02
RU 2035068 C1 5/1995
WO 2000065570 A1 11/2001

OTHER PUBLICATIONS

International Searching Authority of the PCT; "Notificiation of Transmittal of the International Search Report and the Written Opinion of the International Seaching Authority"; PCT Application No. PCT/US21/58052; dated Jan. 26, 2022; pp. 1-10.

* cited by examiner

*Primary Examiner* — Kimberly R Lockett
(74) *Attorney, Agent, or Firm* — FisherBroyles LLP; Kevin D. Jablonski

(57) ABSTRACT

An instrument mouthpiece having an interior wall that includes a plurality of modifications that disrupts airflow through the mouthpiece in order to produce a pleasing sound when a player is playing an instrument. The modifications may comprise raised ridges disposed on the baffle of the or valleys carved into the baffle. Additionally, the modifications may include specific patterns designed to elicit different, yet still pleasing sounds from the instrument. These patterns may include a first pattern having a first central linear modification flanked by a set of modifications having parabolic elongated modifications wherein each modification has a parabolic focus increasingly more distant from each respective modification in a direction away from the central modification and also flanked by a set of modifications having parabolic elongated modifications fashioned in the opposite direction. Another pattern may include modifications that are linear but spaced apart from each other in an increasingly distant pattern.

20 Claims, 5 Drawing Sheets

INSTRUMENT MOUTHPIECE WITH AIR FLOW DISRUPTION APPARATUS

BACKGROUND

Musical instruments are popular and prominent throughout the world in popular culture as well as professional and recreational setting. A specific subset of musical instruments includes wind instruments, whereupon yet another subset of that includes woodwinds. Woodwind instruments are musical instruments comprising a main body used to define a column of air whereupon a mouthpiece is at the front of the body designed to be engaged by a human that provides air by blowing through the mouthpiece. As is well known, within the body the acoustic characteristics of the column may be modified by various means of holes, openings and valves. Further, the air column is vibrated by a wooden reed (i.e., woodwind instrument) disposed in a mouthpiece attached to the body intake by means of a ligature made of metal, or other material. Typically, reeds are made from a cane plant (e.g., wood) but newer methodologies are introducing synthetic materials for reed formation and use.

Musical instrument manufacturers strive to innovate several different aspects of their musical instruments including the body, the mouthpiece and the reed. As different innovations are brought to market, different musicians from different musical genres may tend to embrace or reject innovations as the innovation may affect the overall sound produced by the musical instruments in ways that tend toward classic sounds or toward modern sounds. To this end, with the array of musical tastes and interests in music being beautifully diverse, musical instrument innovators strive to provide novel innovations to appeal to this diversity.

BRIEF DESCRIPTION OF THE DRAWINGS

The subject matter presented herein will now be described, by way of example, with reference to the accompanying drawings, in which.

DETAILED DESCRIPTION

Figure 1:
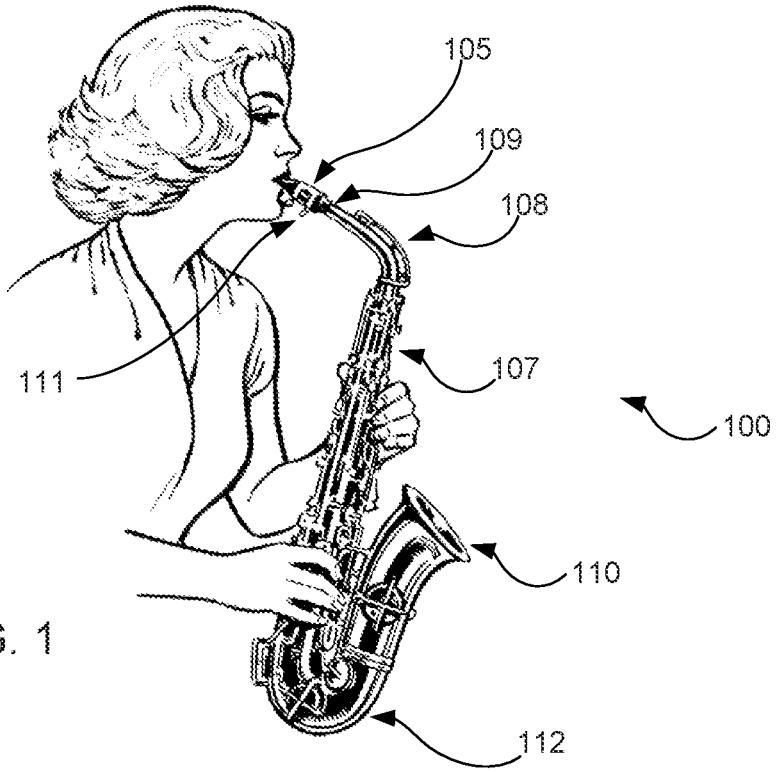
FIG. 1 is a diagram of a musical instrument having a mouthpiece according to an embodiment of the subject matter disclosed herein.

The following detailed description is merely exemplary in nature and is not intended to limit the described embodiments or the application and uses of the described embodiments. As used herein, the word "exemplary or illustrative" means "serving as an example, instance, or illustration." Any implementation described herein as "exemplary" or "illustrative" is not necessarily to be construed as preferred or advantageous over other implementations. AH of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" as required by 35 U.S.C. § 112.

By way of an overview, the descriptions of mouthpieces, instruments and methods disclosed herein are directed to an instrument mouthpiece, neck, or body having an interior wall that includes a plurality of modification on an inner wall that disrupts airflow through the mouthpiece in order to effect a pleasing sound when a player is playing an instrument. In one embodiment, the modifications comprise raised ridges disposed on the baffle of the mouthpiece while in another embodiment, the modification are valleys carved into the baffle. Additionally, the modifications may include specific patterns designed to elicit different, yet still pleasing sounds from the instrument. These patterns may include a first pattern having a first central linear modification flanked by a set of modifications having parabolic elongated modifications wherein each modification has a parabolic focus increasingly more distant from each respective modification in a direction away from the central modification and also flanked by a set of modifications having parabolic elongated modifications fashioned in the opposite direction. In other embodiments, the modifications are linear but spaced apart from each other in an increasingly distant pattern. In still other embodiments, the modifications are sinusoidal modifications. These and other aspects may be more readily understood and further detailed with respect to the detailed description below with reference to FIGS. 1-6.

Turning attention to the figures, FIG. 1 is a diagram of a person playing musical instrument 100 having a mouthpiece 105 according to an embodiment of the subject matter disclosed herein. In this embodiment, the musical instrument 100 is an alto saxophone. For this discussion and throughout this disclosure, the musical instrument may be discussed in terms of an alto saxophone, but the skilled artisan understands that the concepts detailed about the musical instrument mouthpiece 105 apply equally to any woodwind instrument including all manner of saxophones (e.g., tenor saxophones, baritone saxophones, and the like) as well as clarinets, oboes, bassoons, and the like. In FIG. 1, a typical saxophone includes a column 107 configured to direct airflow provided by a player through a mouthpiece toward the column 107 through a neck 108, a body 107 and bow 112 and eventually out the bell 110 as one or more audio tones. The mouthpiece 105 is designed to engage a player's mouth for producing the airflow via a wooden or synthetic reed (not shown) such that the mouthpiece 105 attaches to the instrument 100 adjacent to a neck 109 at a neck cork 109 at the initial opening of the column 107. Further, the reed may be secured to the mouthpiece 105 using a ligature 111. The vibration of the reed produces air flow having a specific wavelength (e.g., tone) that is then altered by opening and closing valves in the column 107 to produce a specific desired note from the instrument 100. In an embodiment described next, specific details about the mouthpiece 105 and the ligature are discussed next with respect to FIGS. 2-5. In further embodiments described later, specific details about the neck 109 are discussed below with respect to FIG. 6.

Figure 2:
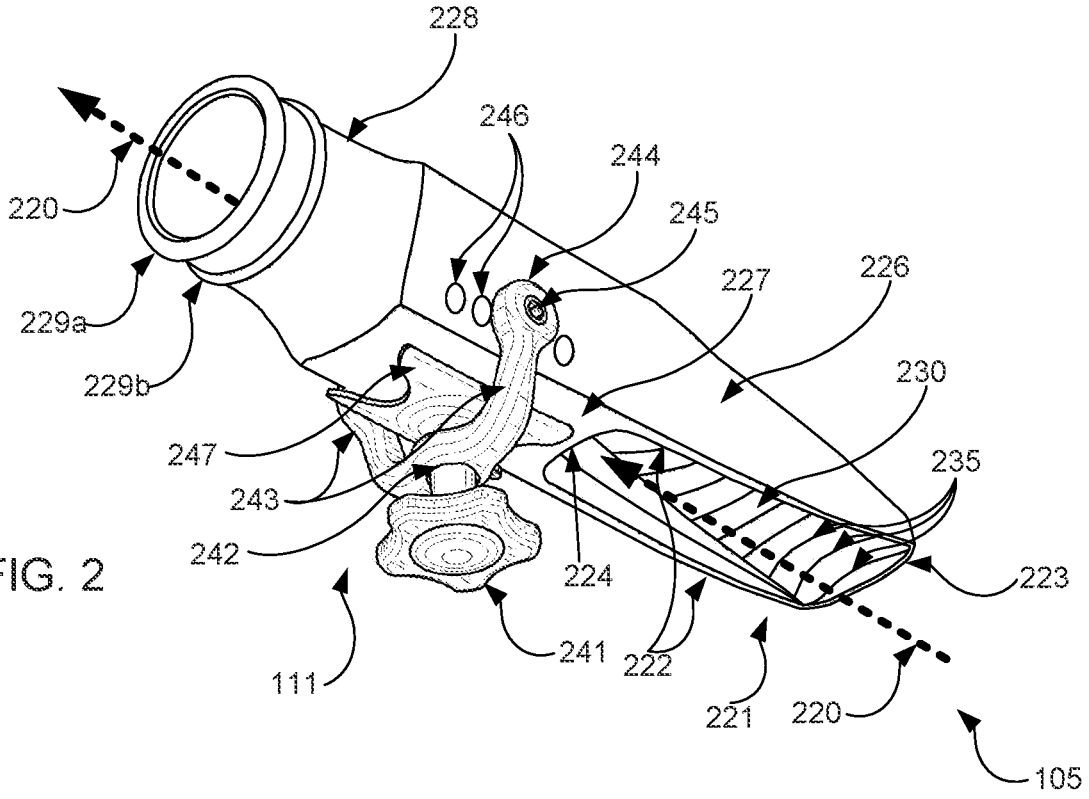
FIG. 2 is a diagram a mouthpiece according to an embodiment of the subject matter disclosed herein.

FIG. 2 is a diagram of a mouthpiece 105 according to an embodiment of the subject matter disclosed herein. Generally speaking, all instruments mouthpieces may be characterized as having a mouthpiece body 226 with a tip 223 disposed at an end configured to engage the human player and a shank 228 configured to engage the instrument column (not shown in FIG. 2). The end having the tip 223 includes a tip opening 221 that is configured to be flanked by two side rails 222 whereupon a reed (not shown) may partially cover the tip opening when secured in place by the ligature 111. The reed is not shown in FIG. 2 such that a baffle 230 (e.g., a top wall of a mouthpiece chamber 224 near the tip opening 221) may be seen whereupon the baffle exhibits modifications 235 that may after the airflow is a musically desirable manner. As such, air flow 220 is directed from a human player through the tip 223 and altered by the baffle 230 having modifications 235 (e.g., grooves or ridges on the wall of the baffle 230) toward a chamber 224 surrounded by the body 226 and then the shank 228 and eventually through the column of the instrument (not shown in FIG. 2), Aspects of the modifications 235 on the baffle 230 are discussed in greater detail below with respect to FIGS. 3-5 below. However next, aspects of the ligature 111 are discussed further.

In the embodiment of FIG. 2, the reed is not shown in an effort to show the baffle 230 having modifications 235 in greater detail. Nonetheless, a reed, when used during playing the instrument, may be secured to the mouthpiece using the ligature to hold the reed against a table 227. A conventional ligature normally extends circumferentially around the entire outer body 226 of the mouthpiece 105. Such conventional ligatures may include integral tightening mechanism used to secure the reed to the mouthpiece 105. Because of the mechanical coupling between the ligature 111, the mouthpiece 105 and the reed, the structure of the ligature 111 plays a role in the sound produced by the instruments, and various types of ligatures 111 are available from different companies, each having its own sound characteristics. Moreover, when the ligature 111 holds the reed in place, its element and the reed are held tightly against the mouthpiece 105 and there is no movement therebetween.

In the embodiment of FIG. 2, the ligature includes two ligature engagement arms 253 that come together at a threaded shaft engagement assembly 242. The threaded shaft may include a ligature screw 241 that may be actuated in a first direction (e.g., clockwise) to move a ligature plate 247 toward the table 227. Likewise, the ligature screw 241 may be actuated in a second direction (e.g., counterclockwise) to move a ligature plate 247 away the table 227. The ligature plate 247 may hold the reed (not shown) securely against the table 227 when tightened. Further, the ligature engagement arms 253 each culminate at a respective ligature arm engagement point 244 having a respective pin 245 configured to engage one of a plurality of ligature engagement holes 246. In this embodiment, each side of the mouthpiece 105 includes five ligature enaagement holes 246 (only one side shown in this perspective), however other embodiment may have from one to eleven holes 246 per side.

The mouthpiece 105 also includes shank rings 229*a*/229*b* on the shank 228, In this embodiment of FIG. 2, the shank 228 includes a proximal shank ring 229*a* that is disposed on the outermost edge of the shank 228 toward the end of the mouthpiece 105 configured to engage the neck on the instrument. Further, the shank 228 includes a distal shank ring 229*b* that is positioned approximately 0.5 inches to 1.5 inches in form the proximal shank ring 229*a*. These shank rings 229*a*/229*b* provide additional mass to the mouthpiece 105 in a manner to produces a pleasing alteration to the sound of the mouthpiece 105 to the instrument.

Figure 3:
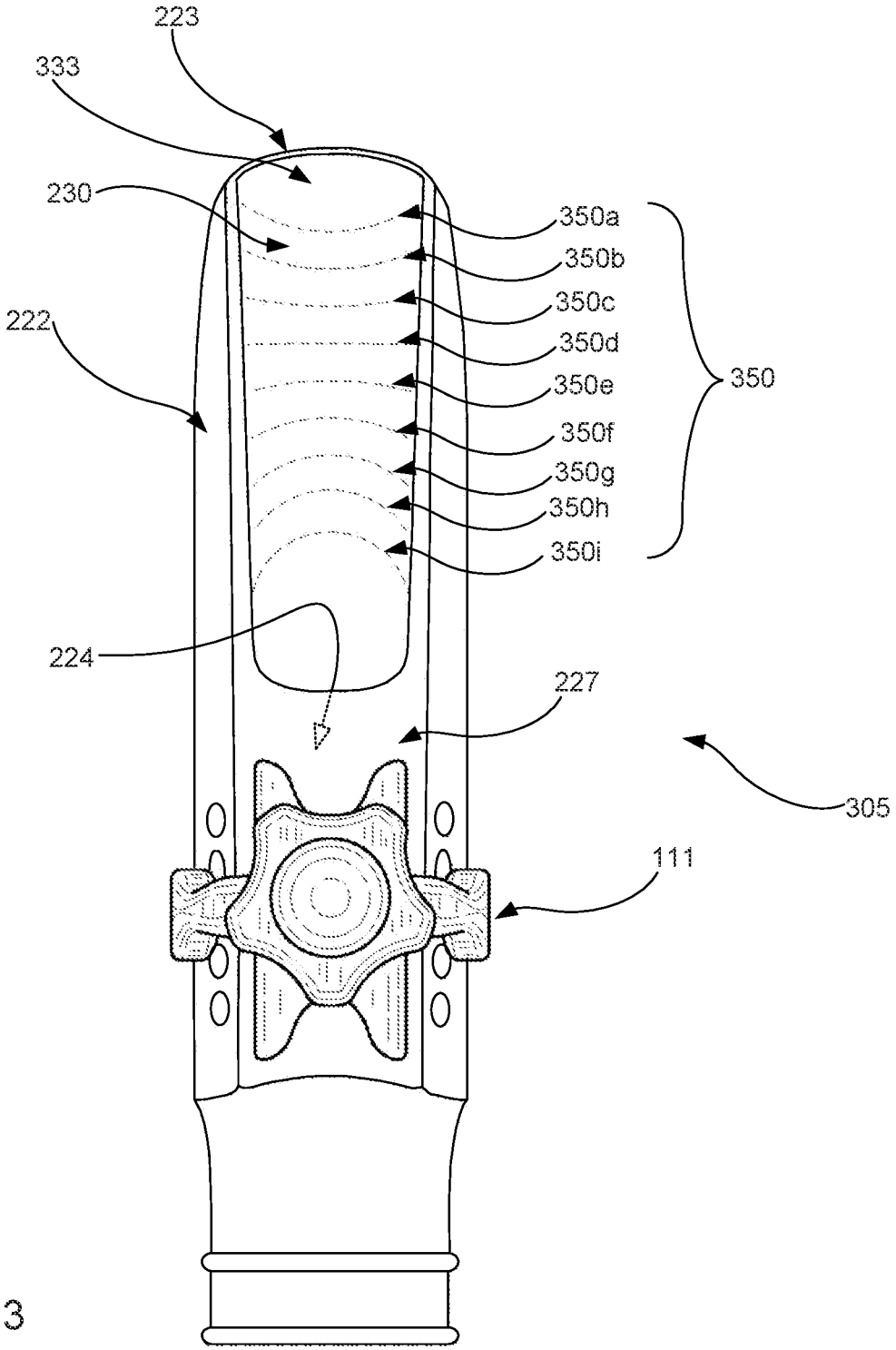
FIG. 3 is a plan view of a first modification pattern of the mouthpiece of FIG. 2 according to an embodiment of the subject matter disclosed herein.

FIG. 3 is a plan view of a first modification pattern 350 of a mouthpiece 305 according to an embodiment of the subject matter disclosed herein. In this embodiment, the pattern 350 is a series of curvilinear modifications disposed on the baffle 230 (e.g., a top wall of the opening of the mouthpiece 305 leading to the mouthpiece chamber 224. Again, this view shows the mouthpiece without a reed disposed thereon so as to adequately show the pattern 350 of the series of curvilinear modifications disposed on the baffle 230. Thus, at the mouthpiece tip 223, a tip opening 333 would normally be present if a reed were to be shown engaged with the mouthpiece (e.g., held against the table 227 by the ligature 111), the tip opening 333 allows a player to generate airflow through the mouthpiece across the baffles 230 that is flanked by side rails 222 into the chamber 224 and ultimately to the column of the attached instrument. Conventional mouthpieces strive to make the baffle 230 as smooth as possible in an effort to reduce any and all resistance to the airflow through the chamber. However, as discussed next, disruption of the airflow in specific manners using carefully crafted patterns of modifications to the baffle 230 introduces pleasing and desirables alterations to the sounds produced by the instrument.

As briefly mentioned above, the embodiment of FIG. 3 shows a pattern 350 of a series of curvilinear modifications disposed on the baffle 230. Each modification 350*a*-350*i* may be a continuous elongated modification to the wall of the baffle 230 such that airflow coming across each modification 350*a*-350*i* is affected in at least a slight manner. That is, a conventional smooth surface would have minimal to zero effect on the overall airflow through the mouthpiece 305. However, the pattern 350 of modifications causes small eddy currents of airflow as air closest to the modifications are caused to change trajectory slightly. As such, the overall airflow may be coherent (or close to coherent at the outset of generating airflow, but the modifications tend to shape to the airflow into less coherency (e.g., airflow having slight eddy currents at the perimeter of the airflow).

The pattern 350 is characterized in this embodiment as nine curvilinear modifications 350*a*-350*i* (more or fewer are contemplated in additional embodiments) that extend from one side rail 222 to the opposite side rail and are disposed on the baffles (e.g., top wall of mouthpiece opening). The pattern 350 in FIG. 3 begins with a first modification 350*a* that includes a parabolic line having a focus fairly close to the tip 223 (e.g., the curve of the parabolic is fairly pronounced. As the pattern 350 progresses to modifications 350*b*, 350*c*, and 350*d*, each next parabolic modification has a respective focus that is further away from the baffle (e.g., the amount of curvature declines with each successive modification). In fact, modification 350*d* may be characterized as strictly linear. As the pattern 350 progresses further to modifications 350*e*-350*i*, the parabolic pattern shifts its focus to the chamber side of the baffle 230. That is, the modifications 350*e*-350*i* begin to curve downward and increasingly more so.

In one embodiment of the mouthpiece 305, the modifications 350*a*-350*i* on the baffles may be grooves such that the modification comprises an indentation into the wall of the baffle 230. In another embodiment of the mouthpiece 305, the modifications 350*a*-350*i* on the baffles may be ridges such that the modification comprises a raised portion disposed on the wall of the baffle 230. The modifications may be etchings or printings and may be integral to the mouthpiece 305 during manufacture. The mouthpiece 305 may be made of a composite material such as rubber, plastic, or porcelain. In other embodiments, the mouthpiece may be made of a metal or metal alloy such as brass or steel. As is discussed next with respect to FIGS. 4-5, the pattern 350 of modifications ay be different so as to produce differently desirable disruptions to the overall airflow.

Figure 4:
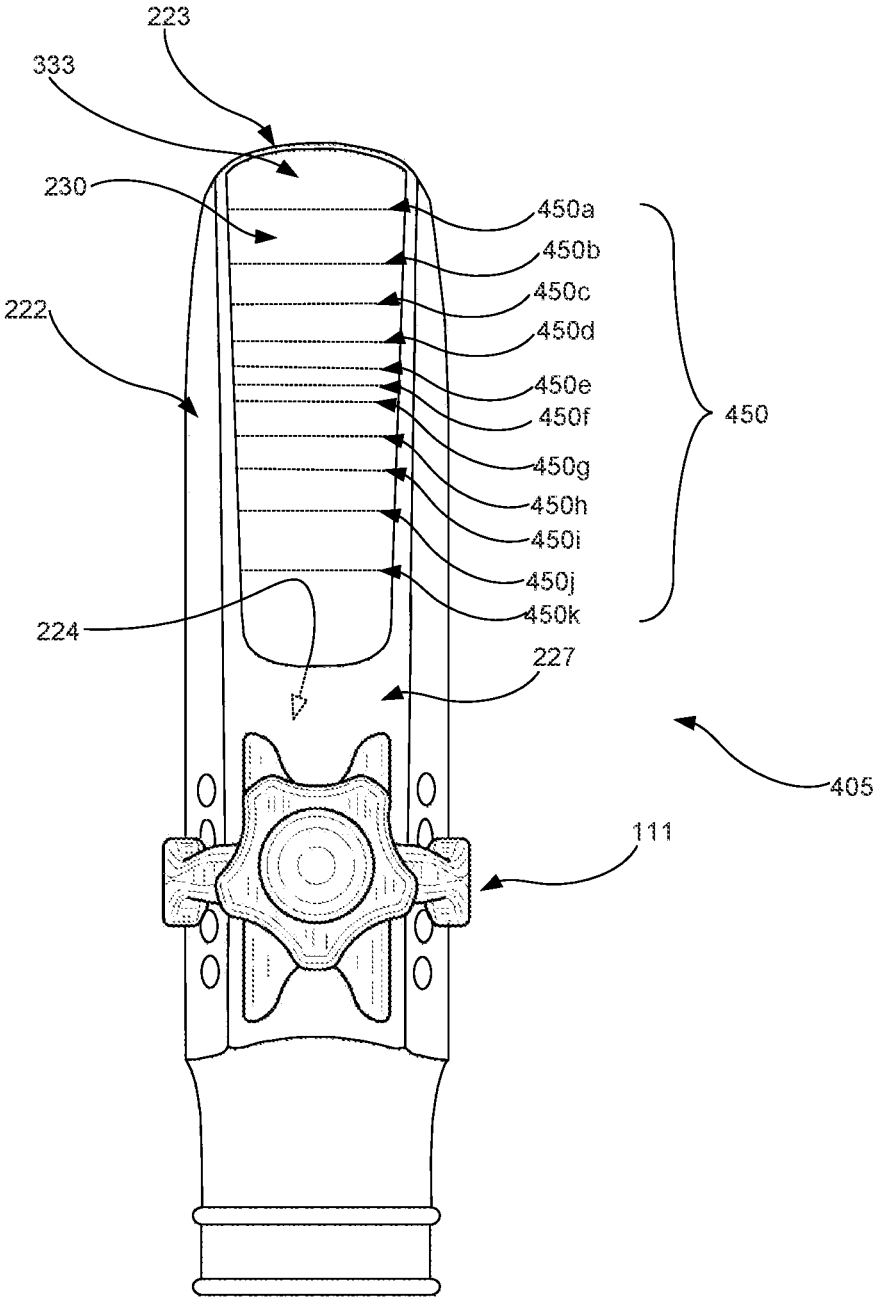
FIG. 4 is a plan view of a first modification pattern of the mouthpiece of FIG. 2 according to an embodiment of the subject matter disclosed herein.

FIG. 4 is a plan view of a second modification pattern 450 of a mouthpiece 405 according to an embodiment of the subject matter disclosed herein. In this embodiment, the pattern 450 is a series of differently distanced linear modifications disposed on the baffle 230 (e.g., a top wall of the opening of the mouthpiece 405 leading to the mouthpiece chamber 224). Again, this view shows the mouthpiece without a reed disposed thereon so as to adequately show the pattern 450 of the series of differently distanced modifications disposed on the baffle 230. Thus, at the mouthpiece tip 223, a tip opening 333 would normally be present if a reed were to be shown engaged with the mouthpiece (e.g., held against the table 227 by the ligature 111), the tip opening 333 allows a player to generate airflow through the mouthpiece across the baffles 230 that is flanked by side rails 222 into the chamber 224 and ultimately to the column of the attached instrument.

The embodiment of FIG. 4 shows a pattern 450 of a series of differently distanced linear modifications disposed on the baffle 230. Each modification 450*a*-450*k* may be a continuous, elongated modification to the wall of the baffle 230 such that airflow coming across each modification 450*a*-450*k* is affected in at least a slight manner. That is, a conventional smooth surface would have minimal to zero effect on the overall airflow through the mouthpiece 405. However, the pattern 450 of modifications causes small eddy currents of airflow as air closest to the modifications are caused to change trajectory slightly. As such, the overall airflow may be coherent (or close to coherent at the outset of generating airflow, but the modifications tend to shape to the airflow into less coherency (e.g., airflow having slight eddy currents at the perimeter of the airflow).

The pattern 450 is characterized in this embodiment as eleven curvilinear modifications 450*a*-450*i* (more or fewer are contemplated in additional embodiments) that extend from one side rail 222 to the opposite side rail and are disposed on the baffles (e.g., top wall of mouthpiece opening). The pattern 450 in FIG. 4 begins with a first modification 450*a* that includes a linear line disposed fairly close to the tip 223. As the pattern 450 progresses to modifications 450*b*, 450*c*, 450*c*, and 450*e*, each next linear modification is disposed at different and smaller distance from the previous modification (e.g., the lines are disposed closer and closer together). When reaching a central modification 450*f*, the pattern 450 may then begin to exhibit larger distances between modification. That is, as the pattern 450 progresses to modifications 450*g*-450*k*, each next linear modification is disposed at different and larger distance from the previous modification (e.g., the lines are disposed further and further apart).

As before, the modifications 450*a*-450*k* on the baffles may be grooves such that the modification comprises an indentation into the wall of the baffle 230 or may be ridges such that the modification comprises a raised portion disposed on the wall of the baffle 230. The modifications may be etchings or printings and may be integral to the mouthpiece 405 during manufacture. The mouthpiece 405 may be made of a composite material such as rubber, plastic, or porcelain. In other embodiments, the mouthpiece may be made of a metal or metal alloy such as brass or steel.

Figure 5:
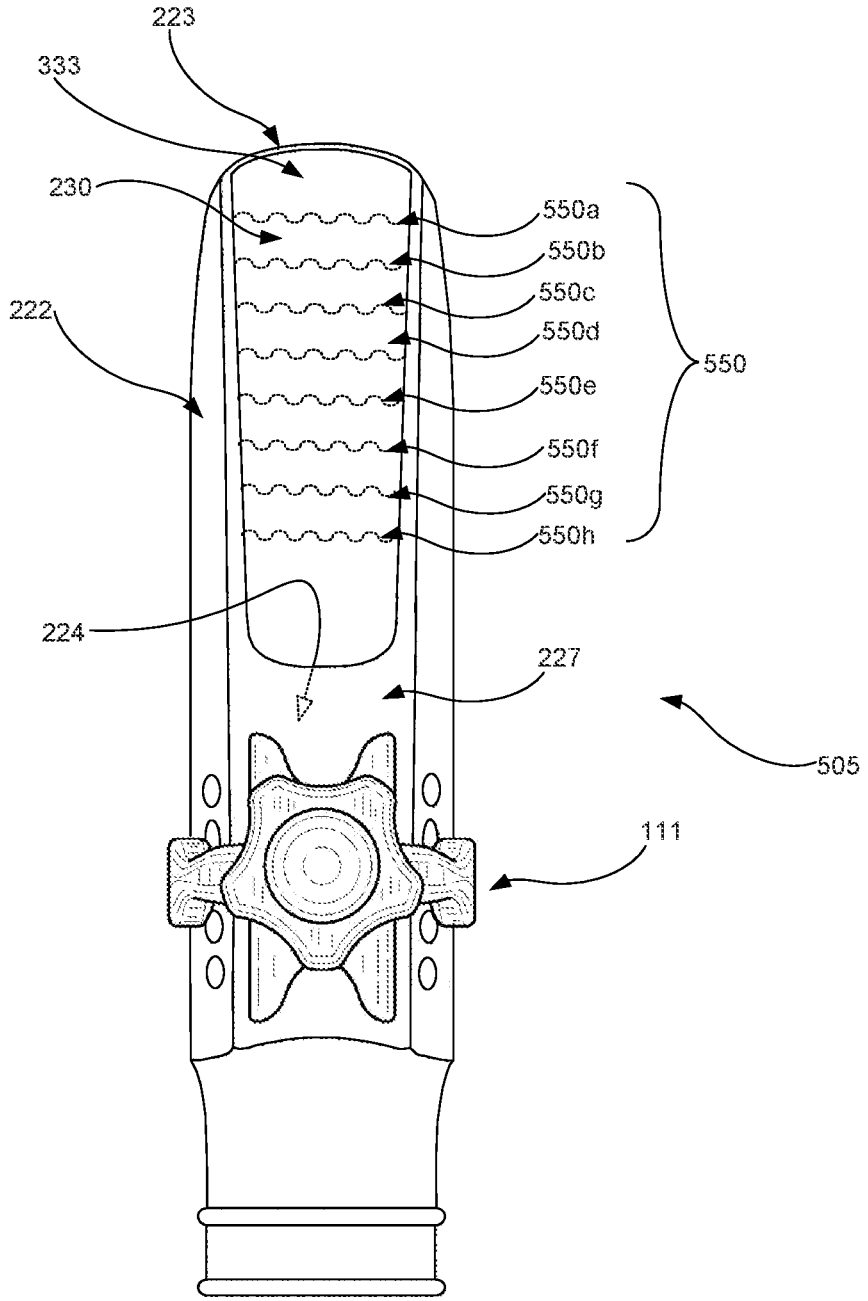
FIG. 5 is a plan view of a first modification pattern of the mouthpiece of FIG. 2 according to an embodiment of the subject matter disclosed herein.

The embodiment of FIG. 5 shows a pattern 550 of a series of differently distanced linear modifications disposed on the baffle 230. Each modification 550*a*-550*h* may be a continuous, sinusoidal modification to the wall of the baffle 230 such that airflow coming across each modification 550*a*-550*h* is affected in at least a slight manner. This pattern 550 is characterized in this embodiment as seven curvilinear modifications 550*a*-550*h* (more or fewer are contemplated in additional embodiments) that extend from one side rail 222 to the opposite side rail and are disposed on the baffles (e.g., top wall of mouthpiece opening). The pattern 550 in FIG. 5 begins with a first modification 550*a* that includes a sinusoidal line disposed fairly close to the tip 223. As the pattern 550 progresses to the remaining modifications 550*b*-550*h*, each next sinusoidal modification is disposed at an equivalent distance from the previous modification (e.g., the sinusoidal modifications are evenly distributed on the baffle)

.

As before, the modifications 550*b*-550*h* on the baffles may be grooves such that the modification comprises an indentation into the wall of the baffle 230 or may be ridges such that the modification comprises a raised portion disposed on the wall of the baffle 230. The modifications may be etchings or printings and may be integral to the mouthpiece 505 during manufacture. The mouthpiece 505 may be made of a composite material such as rubber, plastic, or porcelain. In other embodiments, the mouthpiece 505 may be made of a metal or metal alloy such as brass or steel.

Figure 6:
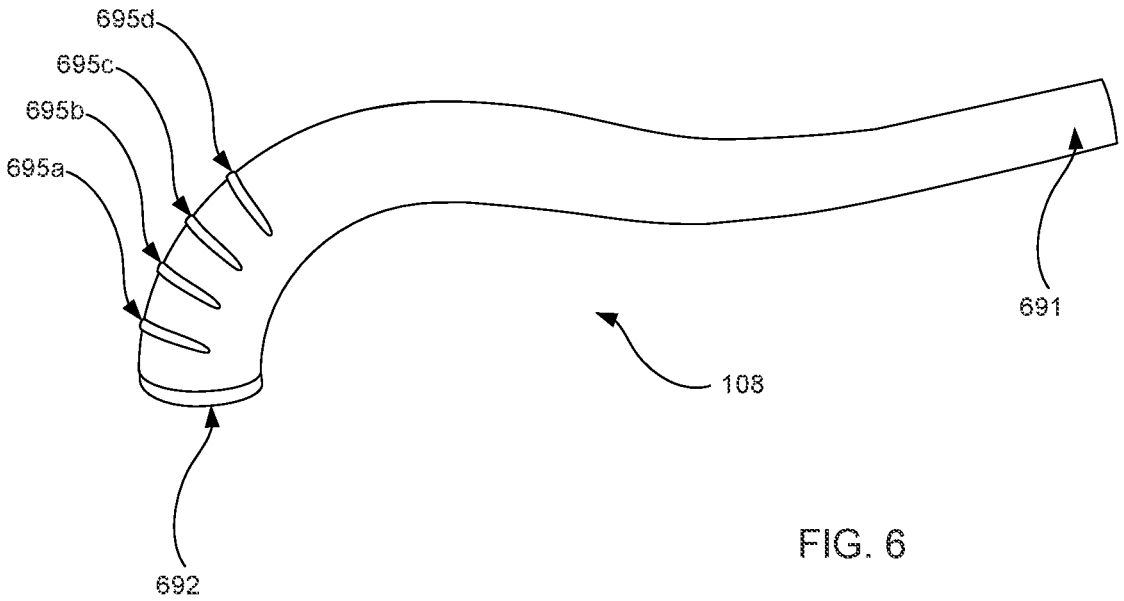
FIG. 6 is a diagram a neck according to an embodiment of the subject matter disclosed herein.

FIG. 6 is a view of a neck 109 of a musical instrument having a modification pattern 695 according to an embodiment of the subject matter disclosed herein. In this embodiment, the pattern is a series of curvilinear modifications 695*a*-*d* disposed on an interior wall of the neck 109 adjacent to an end 692 of the neck 109 to be coupled to the instrument body 107 (not shown in FIG. 6). In other embodiments not shown, curvilinear modifications 695*a*-*d* may be disposed on an interior wall of the neck 109 adjacent to an end 691 of the neck 109 to be coupled to the mouthpiece 105 (not shown in FIG. 6). Conventional necks strive to make the interior walls of the neck as smooth as possible in an effort to reduce any and all resistance to the airflow through the chamber to the instrument column. However, as discussed previously, disruption of the airflow in specific manners using carefully crafted patterns of modifications to the interior walls of instruments parts prior to the column introduces pleasing and desirables alterations to the sounds produced by the instrument.

The embodiment of Fla 6 shows a pattern of a series of curvilinear modifications 695*a*-*d* disposed on the interior wall of the neck 109. Each modification 695*a*-*d* may be a continuous elongated modification to the interior wall of the neck 109 such that airflow coming across each modification 695*a*-*d* is affected in at least a slight manner. That is, a conventional smooth surface would have minimal to zero effect on the overall airflow through the neck 109. However, the pattern of modifications 695*a-d* causes small eddy currents of airflow as air closest to the modifications are caused to change trajectory slightly. As such, the overall airflow may be coherent (or close to coherent at the outset of generating airflow, but the modifications tend to shape to the airflow into less coherency (e.g., airflow having slight eddy currents at the perimeter of the airflow).

The pattern is characterized in this embodiment as four curvilinear modifications 695*a-d* (more or fewer are contemplated in additional embodiments) that extend approximately half way around the circumference of the neck 109. In one embodiment, the modifications 695*a-d* may be grooves such that the modification comprises an indentation into the wall of the neck 109. That is, as shown, the modifications 695*a-d* protrude from the exterior wall of the neck 109. In another embodiment, the modifications 695*a-d* may be ridges such that the modification comprises a raised portion disposed on the wall of the neck 230. That is, as shown, the modifications 695*a-d* protrude from the interior wall of the neck 109. The modifications may be etchings or printings and may be integral to the neck 109 during manufacture. The neck 109 may be made of a composite material such as rubber, plastic, or porcelain. In other embodiments, the neck 109 may be made of a metal or metal ahoy such as brass or steel. As is discussed previously with respect to FIGS. 3-5, the pattern of modifications 695*a-d* may be different so as to produce differently desirable disruptions to the overall airflow. In yet other embodiment, the modification may be disposed on walls of the body 107, bow 112, or bell 110 as well as combination thereof.

What has been described above includes examples of aspects of the claimed subject matter. It is, of course, not possible to describe every conceivable combination of components or methodologies for purposes of describing the claimed subject matter, but one of ordinary skill in the art may recognize that many further combinations and permutations of the disclosed subject matter are possible. Accordingly, the disclosed subject matter is intended to embrace all such alterations, modifications and variations that fall within the spirit and scope of the appended claims. Furthermore, to the extent that the terms "includes," "has" or "having" are used in either the detailed description or the claims, such terms are intended to be inclusive in a manner similar to the term "comprising" as "comprising" is interpreted when employed as a transitional word in a claim.

Since many alterations, variations, and changes in detail can be made to the described preferred embodiments of the subject matter, it is intended that all matters in the foregoing description and shown in the accompanying drawings be interpreted as illustrative and not in a limiting sense. Thus, the scope of the subject matter should be determined by the appended claims and their legal equivalence.

What is claimed is:

1. A mouthpiece for a musical instrument, comprising:

an air pathway through a chamber configured to direct air toward a column in a reeded musical instrument;

a wall disposed in an opening to the chamber, the wall configured to receive an adjacent reed; and a plurality of modifications disposed on the wall.

2. The mouthpiece of claim 1, wherein the plurality of modifications comprise ridges raised beyond a surface of the wall.

3. The mouthpiece of claim 1, wherein the plurality of modifications comprise valleys etched into a surface of the wall.

4. The mouthpiece of claim 1, wherein the plurality of modifications comprises:

a first set of modifications having linear elongated modifications disposed on the wall in a first location of the wall between the chamber and a tip of the mouthpiece;

a second set of modifications having parabolic elongated modifications disposed on the wall in a second location of the wall between the first set and the tip of the mouthpiece, each modification in the second set having a parabolic focus increasingly more distant from each respective modification in a direction away from the first set; and a third set of modifications having parabolic elongated modifications disposed on the wall in an third location of the wall between the first set and the chamber of the mouthpiece, each modification in the third set having a parabolic focus increasingly more distant from each respective modification in a direction away from the first set.

5. The mouthpiece of claim 1, wherein the plurality of modifications comprises:

a first set of modifications having linear elongated modifications disposed on the wall in a first location of the wall between the chamber and a tip of the mouthpiece;

a second set of modifications having linear elongated modifications disposed on the wall in a second location of the wall between the first set and the tip of the mouthpiece, each modification in the second set disposed increasingly more distant from a respective previous modification in a direction away from the first set; and a third set of curvilinear modifications having linear elongated modifications disposed on the wall in a third location of the wall between the first set and the chamber of the mouthpiece, each modification in the second set disposed increasingly more distant from a respective previous modification in a direction away from the first set.

6. A mouthpiece for a musical instrument, comprising:

an air pathway through a chamber configured to direct air toward a column in a musical instrument;

a wall disposed in an opening to the chamber; and a plurality of modifications disposed on the wall;

wherein the plurality of modifications comprises sinusoidal modifications disposed on the wall between the chamber and a tip of the mouthpiece.

7. The mouthpiece of claim 1, further comprising a shank disposed adjacent to the chamber and having:

a first shank ring disposed on the shank at an edge of the shank; and a second shank ring disposed on the shank apart from the first shank ring.

8. A mouthpiece for a musical instrument, comprising:

an air pathway through a chamber configured to direct air toward a column in a musical instrument;

a wall disposed in an opening to the chamber; and a plurality of modifications disposed on the wall;

the mouthpiece further comprising a ligature for holding a reed next to the mouthpiece, the ligature including a first ligature arm for engaging one of a first set of a plurality of holes disposed on a first side of the mouthpiece and a second ligature arm for engaging one of a second set of holes disposed on a second side of the mouthpiece.

9. The mouthpiece of claim 8, wherein the first and second set of holes comprises five holes in each set.

10. The mouthpiece of claim 8, further comprising a ligature screw operably coupling the first ligature arm and the second ligature arm and configured to tighten or loosen the ligature holding the reed next to the mouthpiece.

11. A reeded musical instrument, comprising:

a body having a column for airflow disposed therein;

a neck configured to be attached to the body;

a mouthpiece configured to be attached to the neck;

an air pathway through a chamber configured to direct air toward the column;

a wall disposed in an opening to the chamber, the wall configured to receive an adjacent reed; and a plurality of modifications disposed on the wall.

12. The musical instrument of claim 11, further comprising:

a reed disposed adjacent to an opening of the mouthpiece; and a ligature for holding the reed next to the mouthpiece, the ligature including a first ligature arm for engaging one of a first set of a plurality of holes disposed on a first side of the mouthpiece and a second ligature arm for engaging one of a second set of holes disposed on a second side of the mouthpiece.

13. The musical instrument of claim 11, wherein the plurality of modifications comprises:

a first set of modifications having linear elongated modifications disposed on the wall in a first location of the wall between the chamber and a tip of the mouthpiece;

a second set of modifications having parabolic elongated modifications disposed on the wall in a second location of the wall between the first set and the tip of the mouthpiece, each modification in the second set having a parabolic focus increasingly more distant from each respective modification in a direction away from the first set; and a third set of modifications having parabolic elongated modifications disposed on the wall in an third location of the wall between the first set and the chamber of the mouthpiece, each modification in the third set having a parabolic focus increasingly more distant from each respective modification in a direction away from the first set.

14. The musical instrument of claim 11, wherein the plurality of modifications comprises:

a first set of modifications having linear elongated modifications disposed on the wall in a first location of the wall between the chamber and a tip of the mouthpiece;

a second set of modifications having linear elongated modifications disposed on the wall in a second location of the wall between the first set and the tip of the mouthpiece, each modification in the second set disposed increasingly more distant from a respective previous modification in a direction away from the first set; and a third set of curvilinear modifications having linear elongated modifications disposed on the wall in a third location of the wall between the first set and the chamber of the mouthpiece, each modification in the second set disposed increasingly more distant from a respective previous modification in a direction away from the first set.

15. The musical instrument of claim 11, wherein the plurality of modifications comprises sinusoidal modifications disposed on the wall between the chamber and a tip of the mouthpiece.

16. The musical instrument of claim 11 further comprising an instrument from the group comprised of an alto saxophone, a tenor saxophone, a baritone saxophone, a clarinet, an oboe, and a bassoon.

17. A method for passing air through a mouthpiece of a musical instrument, the method comprising directing airflow through a chamber having an opening that comprises at least one first baffle wall having an adjacent reed;

disrupting the flow of air though the chamber by passing the airflow over a plurality of ridges disposed on the baffle wall as the airflow passes the reed; and directing the disrupted airflow to a column.

18. The method of claim 17, wherein the disrupting further comprises:

directing air to pass over a first set of modifications having linear elongated modifications disposed on the wall in a first location of the wall between the chamber and a tip of the mouthpiece;

directing air to pass over a second set of modifications having parabolic elongated modifications disposed on the wall in a second location of the wall between the first set and the tip of the mouthpiece, each modification in the second set having a parabolic focus increasingly more distant from each respective modification in a direction away from the first set; and directing air to pass over a third set of modifications having parabolic elongated modifications disposed on the wall in an third location of the wall between the first set and the chamber of the mouthpiece, each modification in the third set having a parabolic focus increasingly more distant from each respective modification in a direction away from the first set.

19. The method of claim 17, wherein the disrupting further comprises:

directing air to pass over a first set of modifications having linear elongated modifications disposed on the wall in a first location of the wall between the chamber and a tip of the mouthpiece;

directing air to pass over a second set of modifications having linear elongated modifications disposed on the wall in a second location of the wall between the first set and the tip of the mouthpiece, each modification in the second set disposed increasingly more distant from a respective previous modification in a direction away from the first set; and directing air to pass over a third set of curvilinear modifications having linear elongated modifications disposed on the wall in a third location of the wall between the first set and the chamber of the mouthpiece, each modification in the second set disposed increasingly more distant from a respective previous modification in a direction away from the first set.

20. The method of claim 17, wherein the disrupting further comprises directing air to pass over sinusoidal modifications disposed on the wall between the chamber and a tip of the mouthpiece.

* * * * *